US006042520A

United States Patent [19]

Cantero

[11] Patent Number: 6,042,520

[45] Date of Patent: Mar. 28, 2000

[54] DEVICE FOR STRETCHING AND INCREASING THE FLEXIBILITY OF THE FOOT

[76] Inventor: David Campos Cantero, C. Provenca, 577, Barcelona, Spain, 08026

[21] Appl. No.: 09/031,029

[22] Filed: Feb. 26, 1998

[30] Foreign Application Priority Data

Mar. 13, 1997 [ES] Spain ..... 9700652

[51] Int. Cl.[7] ..... A63B 23/04

[52] U.S. Cl. ..... 482/79; 482/140; 482/907

[58] Field of Search ..... 482/23, 79, 131, 482/139, 140, 148, 907; 602/6, 27–29, 62; 128/845, 882; 5/648–651; D21/685; D24/192, 213; 601/27, 28, 33; 606/241; 36/8.3, 11.5, 140, 142–144

[56] References Cited

U.S. PATENT DOCUMENTS

| | | | |
|---|---|---|---|
| 1,525,848 | 2/1925 | Bonaventure | 36/8.3 |
| 1,730,466 | 10/1929 | Mallott | 36/140 |
| 1,801,769 | 4/1931 | Gartner | 482/79 |
| 1,989,899 | 2/1935 | Vance | 482/79 |
| 3,468,040 | 9/1969 | Fukouka | 36/11.5 |
| 3,472,508 | 10/1969 | Baker et al. | 482/79 |
| 4,235,028 | 11/1980 | Riggs | 36/80 |
| 4,333,472 | 6/1982 | Tager | 36/140 |
| 4,444,389 | 4/1984 | Wrucke | 482/79 |
| 5,453,082 | 9/1995 | Lamont | 601/27 |
| 5,791,000 | 8/1998 | Noyes | 5/657 |

FOREIGN PATENT DOCUMENTS

| | | | |
|---|---|---|---|
| 3436554 | 4/1986 | Germany | 482/79 |
| 415673 | 8/1934 | United Kingdom | 482/79 |

*Primary Examiner*—Richard J. Apley
*Assistant Examiner*—Jayne Saydah
*Attorney, Agent, or Firm*—Steinberg & Raskin, P.C.

[57] ABSTRACT

Device for stretching and increasing the flexibility of a human foot and leg including an elongate member including a first recess arranged proximate a first end and adapted to receive the sole of the foot, a second recess arranged alongside the first recess closer to a second end of the member opposite the first end and adapted to receive the heel of the foot, a projection arranged alongside the second recess closer to the second end of the member, and a third recess arranged alongside the projection closer to the second end of the member and adapted to receive a calf of the foot. An elastic band is provided to secure the foot in contact with the member.

4 Claims, 3 Drawing Sheets

DEVICE FOR STRETCHING AND INCREASING THE FLEXIBILITY OF THE FOOT

The present invention relates to a device for stretching and increasing the flexibility of the foot, especially for the use of sportspersons engaging in activities which require development of the instep, such as rhythmic or competition gymnastics, horse apparatus exercises and other similar forms of gymnastics.

BACKGROUND OF THE INVENTION

Known in the art are various mechanisms which serve to work the elasticity of feet and legs. It is usual to use elastic or mechanical mechanisms which carry out this function, which mechanisms can be found in gymnasiums or sports centres, due to their dimensions and imposing appearance.

The above-mentioned sports disciplines call for continued dedication under constant working conditions, that is, improved or increased flexibility of certain zones of the body has to be worked on regularly and if possible with the same mechanisms. The above-mentioned mechanisms nevertheless have the disadvantage that owing to their considerable size they cannot be transported easily, nor used or installed in certain rooms. Likewise, and for the same reasons, they are very highly priced, and this is a major problem if the person who has to acquire them is a sportsperson who aims to use them for his or her exclusive use and in the room or place in which the sportsperson plans to train.

DESCRIPTION OF THE INVENTION

The device of the invention solves the aforesaid disadvantages, while at the same time providing other advantages which will be described below.

The device of the invention for stretching and increasing the flexibility of the foot is characterized in that it includes an elongate member which has a number of recesses and projections, the sole of the foot and the heel adapting to the recesses, and it further has means for securing the foot which keep the end thereof in constant contact with the member so that the upper part of the foot follows a convex curvature.

Thanks to these characteristics, this device can be used anywhere, for it occupies hardly any space, and also has the advantage that it can be transported without problem.

Another advantage presented by this device is that it is suitable for stretching the foot and increasing its flexibility in open position from the ankle ("cou de pied"), a position required especially for classical ballet and dance. This device has as an important, complementary utility in the artistic and academic dance training spheres the fact that, by using it with pointe ballet shoes, it serves to mould them correctly and give them the right shape. Moreover, utilization of this device embellishes the line of the leg by helping to rotate the hip joint outwards ("en dehors").

Preferably, the device of the invention includes means for alleviating overload of the astragalus-calcaneus bone abutment by means of a pad which is situated between the device and the affected zone of the heel. Individuals whose astragalus-calcaneus bone abutment zone is more highly developed can thus resort to use of the pad in order to avoid the effects of overloading on this zone when it is pressed against the device. We might also emphasize the increased stretching thereby achieved by the foot.

Advantageously, the recesses in the device of the invention are symmetrical with respect to the longitudinal axis of the device.

Thanks to this characteristic, the same device can be used for both the right foot and the left foot.

Also advantageously, the means for securing the foot include a band of elastic material which secures the foot, arranged around the end of the device.

BRIEF DESCRIPTION OF THE DRAWINGS

For a better understanding of all that is set out in the present specifications some drawings are attached which, solely by way of example, show a practical case of embodiment of a device for stretching and increasing the flexibility of the foot.

In said drawings.

DESCRIPTION OF A PREFERRED EMBODIMENT

Figure 1:
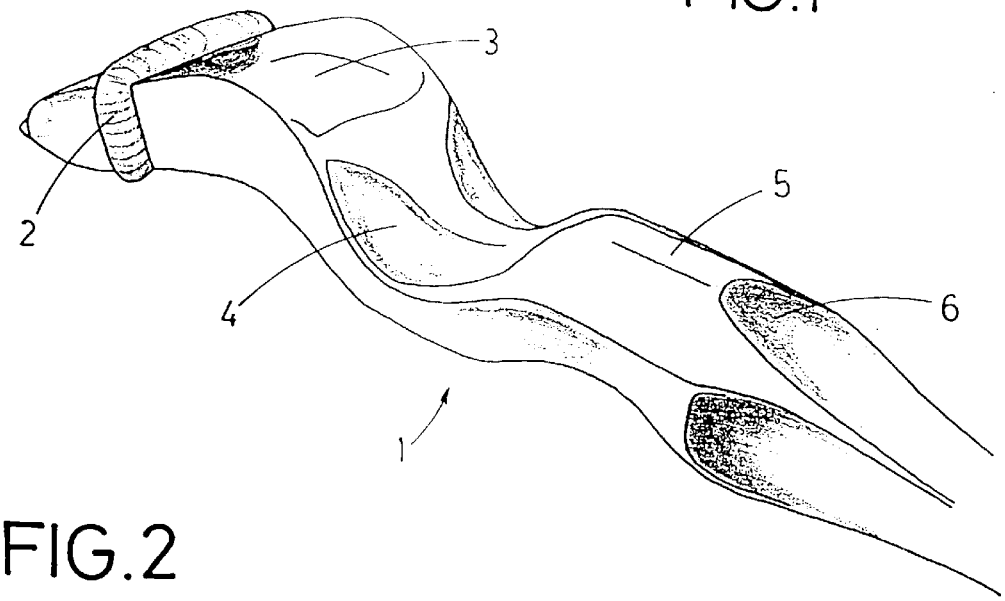
FIGS. 1 and 2 show perspective views of the device of the invention.
Figure 2:
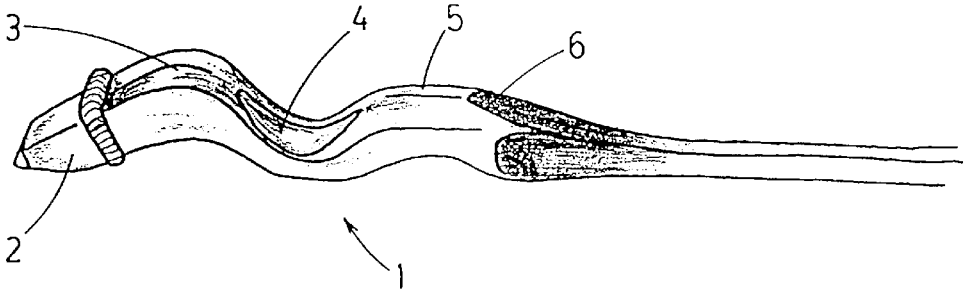

As can be seen from FIGS. 1 and 2, this is a one-piece device 1 which presents a plurality of recesses 3, 4 and 6 in which the sole of the foot, the heel and the rear part of the ankle (calf), respectively, are placed. The band of elastic material 2, which in these two figures is rolled up, is arranged around the end of the device 1 and serves to secure the instep of the foot when placed on the device 1. The central projection 5 is especially useful for making the stretching action more intensive.

Figure 3:
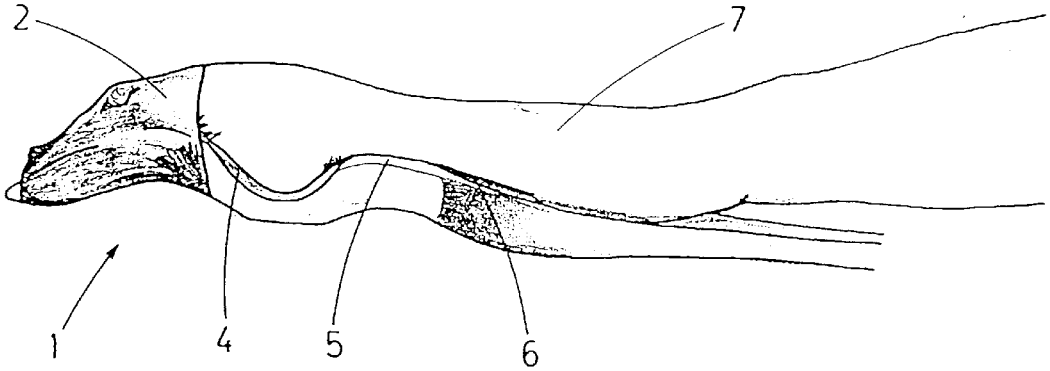
FIG. 3 is similar to the two preceding figures, but it shows how the foot is secured to the device.

FIG. 3 shows the placement of the leg 7 of a sportsperson performing stretching exercises with the device 1 of the invention. This figure shows how the plurality of curvatures 3, 4 and 6 included in the device 1 in question adapt correctly to the outline of the leg 7 which is being stretched.

Figure 4:
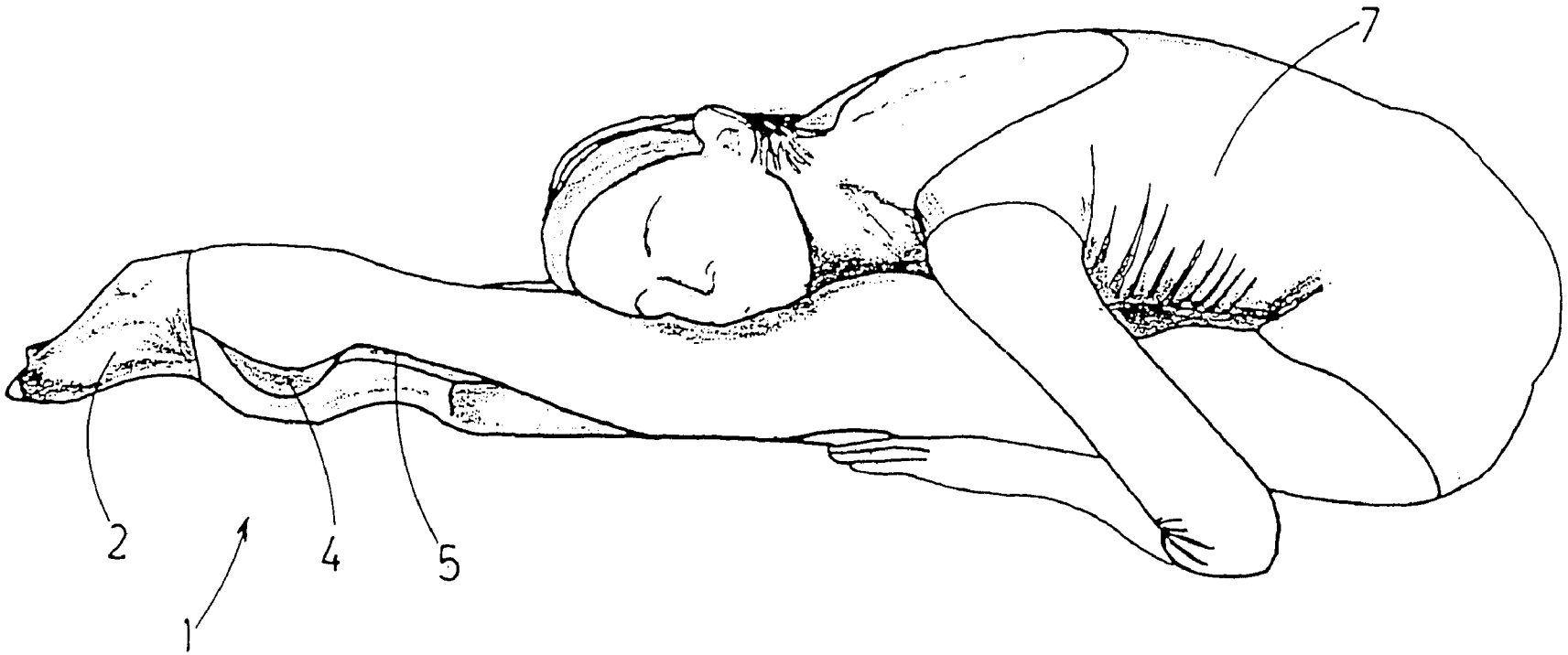
FIG. 4 shows a gymnast performing stretching exercises with the device of the invention.

FIG. 4 shows how the small dimensions of the device 1 of the invention allow work to be done on the elasticity of the legs in any room.

Figure 5:
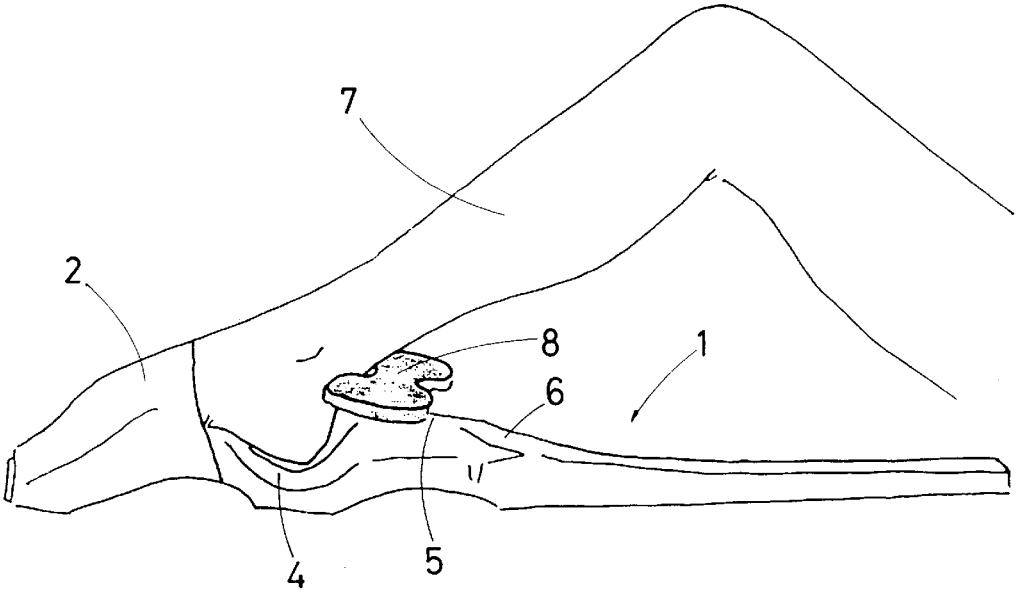
FIGS. 5 and 6 show how to fit the pad which helps to alleviate overloading of the astragalus-calcaneus bone abutment.
Figure 6:
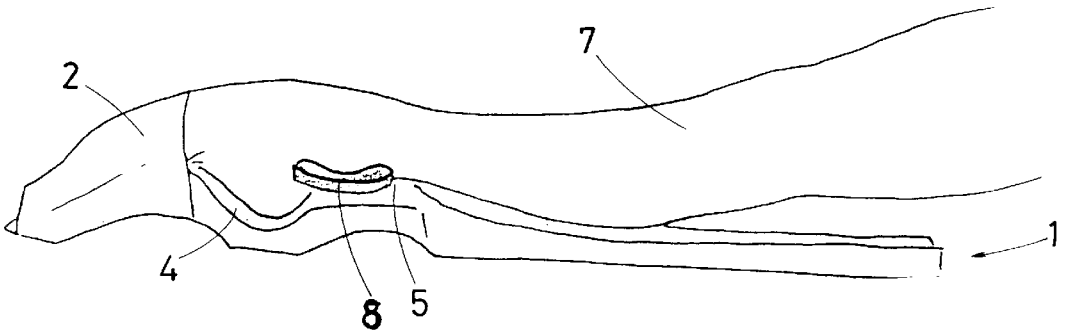

FIGS. 5 and 6 show how the pad 8 is attached under the zone of the astragalus-calcaneus bone abutment, in such a way that contact between leg 7 and device 1 is made as comfortably as possible. It is clear that, in order to perform the stretching exercises more comfortably, various pads 8 can be placed at the same time between the leg 7 and the plurality of curved zones 3, 4 and 6 of the device of the invention.

Independent of the object of the invention are the materials used for manufacturing the components of the device of the invention, the shapes and dimensions thereof and all accessory details that may be presented, as long as they do not affect its essential nature.

I claim:

1. A device for stretching and increasing the flexibility of a human foot and leg, comprising an elongate member including a first recess arranged proximate a first end structured and arranged to receive a sole of the foot, a second recess arranged alongside said first recess closer to a second end of said member opposite said first end of said member structured and arranged to receive a heel of the foot, a projection arranged alongside said second recess closer to said second end of said member, and a third recess arranged alongside said projection closer to said second end of said member structured and arranged to receive a calf of the leg, and means for alleviating overload of the astragalus-calcaneus bone abutment of the foot, and securing means for securing the foot in contact with said member.

2. The device of claim 1, wherein said means for alleviating overload of the astragalus-calcaneus bone abutment comprise a pad.

3. A device for stretching and increasing the flexibility of a human foot and leg, comprising an elongate member including recesses and projections structured and arranged to engage with portions of the foot and leg above the ankle, at least one of said recesses being structured and arranged to receive the calf of the leg, and means for alleviating overload of the astragalus-calcaneus bone abutment of the foot, and securing means for securing the foot in contact with said member such that an upper part of the foot follows a convex curvature.

4. The device of claim 3, wherein said means for alleviating overload of the astragalus-calcaneus bone abutment comprise a pad.

* * * * *